US006389730B1

(12) United States Patent
Millard

(10) Patent No.: US 6,389,730 B1
(45) Date of Patent: May 21, 2002

(54) FIREARM SIGHTING AID DEVICE

(76) Inventor: Marlo D. Millard, 12101 Rainbow Ave., Anchorage, AK (US) 99516-1944

( * ) Notice: Subject to any disclaimer, the term of this patent is extended or adjusted under 35 U.S.C. 154(b) by 0 days.

(21) Appl. No.: 09/573,971

(22) Filed: May 19, 2000

(51) Int. Cl.[7] ..... F41C 27/00
(52) U.S. Cl. ..... 42/116
(58) Field of Search ..... 42/116, 114

(56) References Cited

U.S. PATENT DOCUMENTS 3,782,832 A * 1/1974 Hacskaylo ..... 356/153
4,879,814 A * 11/1989 Wallace et al. ..... 33/234
5,365,669 A 11/1994 Rustick et al.
5,446,535 A * 8/1995 Williams ..... 356/153
5,454,168 A 10/1995 Langner
5,488,795 A * 2/1996 Sweat ..... 42/103
5,531,040 A 7/1996 Moore
5,685,106 A 11/1997 Shoham
D389,221 S 1/1998 Borg
5,787,631 A 8/1998 Kendall
6,151,788 A * 11/2000 Cox et al. ..... 33/286
6,216,381 B1 * 4/2001 Strand ..... 42/103

OTHER PUBLICATIONS

Copy of "Cabela's" Fall 2000 catalog describing "Accurizer". p. 515, Cabela's Inc., One Cabela Drive, Sidney, NE 69160.

* cited by examiner

*Primary Examiner*—Michael J. Carone
*Assistant Examiner*—M. Thomson

(57) ABSTRACT

A firearm sighting aid device for making it easier and quicker to adjust the sights of a firearm. The firearm sighting aid device includes a housing having an open front end, an open back end, and a compartment disposed therein with the housing being adapted to be received in a chamber of a firearm; and also includes an endcap member being removably attached to the back end of the housing to essentially close the back end of the housing and to close access to the compartment; and further includes a light-emitting member securely disposed in the compartment near the front end of the housing and being adapted to emit a beam of light through the open front end of the housing and through a bore and out of a barrel of the firearm; and also includes energizing assembly for energizing the light-emitting member.

3 Claims, 2 Drawing Sheets

FIREARM SIGHTING AID DEVICE

BACKGROUND OF THE INVENTION

1. Field of the Invention

The present invention relates to a sighting aid for a firearm and more particularly pertains to a new firearm sighting aid device for making it easier and quicker to adjust the sights of a firearm.

2. Description of the Prior Art

The use of a sighting aid for a firearm is known in the prior art. More specifically, a sighting aid for a firearm heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,365,669; U.S. Pat. No. 5,454,168; U.S. Pat. No. 5,787,631; U.S. Pat. No. 5,531,040; U.S. Pat. No. 5,685,106; and U.S. Pat. No. Des. 389,221.

While these devices fulfill their respective, particular objectives and requirements, the aforementioned patents do not disclose a new firearm sighting aid device. The inventive device includes a housing having an open front end, an open back end, and a compartment disposed therein with the housing being adapted to be received in a chamber of a firearm; and also includes an endcap member being removably attached to the back end of the housing to essentially close the back end of the housing and to close access to the compartment; and further includes a light-emitting member securely disposed in the compartment near the front end of the housing and being adapted to emit a beam of light through the open front end of the housing and through a bore and out of a barrel of the firearm; and also includes energizing assembly for energizing the light-emitting member.

In these respects, the firearm sighting aid device according to the present invention substantially departs from the conventional concepts and designs of the prior art, and in so doing provides an apparatus primarily developed for the purpose of making it easier and quicker to adjust the sights of a firearm.

SUMMARY OF THE INVENTION

In view of the foregoing disadvantages inherent in the known types of sighting aid for a firearm now present in the prior art, the present invention provides a new firearm sighting aid device construction wherein the same can be utilized for making it easier and quicker to adjust the sights of a firearm.

The general purpose of the present invention, which will be described subsequently in greater detail, is to provide a new firearm sighting aid device which has many of the advantages of the sighting aid for a firearm mentioned heretofore and many novel features that result in a new firearm sighting aid device which is not anticipated, rendered obvious, suggested, or even implied by any of the prior art sighting aid for a firearm, either alone or in any combination thereof.

To attain this, the present invention generally comprises a housing having an open front end, an open back end, and a compartment disposed therein with the housing being adapted to be received in a chamber of a firearm; and also includes an endcap member being removably attached to the back end of the housing to essentially close the back end of the housing and to close access to the compartment; and further includes a light-emitting member securely disposed in the compartment near the front end of the housing and being adapted to emit a beam of light through the open front end of the housing and through a bore and out of a barrel of the firearm; and also includes energizing assembly for energizing the light-emitting member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new firearm sighting aid device which has many of the advantages of the sighting aid for a firearm mentioned heretofore and many novel features that result in a new firearm sighting aid device which is not anticipated, rendered obvious, suggested, or even implied by any of the prior art sighting aid for a firearm, either alone or in any combination thereof.

It is another object of the present invention to provide a new firearm sighting aid device which may be easily and efficiently manufactured and marketed.

It is a further object of the present invention to provide a new firearm sighting aid device which is of a durable and reliable construction.

An even further object of the present invention is to provide a new firearm sighting aid device which is susceptible of a low cost of manufacture with regard to both materials and labor, and which accordingly is then susceptible of low prices of sale to the consuming public, thereby making such firearm sighting aid device economically available to the buying public.

Still yet another object of the present invention is to provide a new firearm sighting aid device which provides in the apparatuses and methods of the prior art some of the advantages thereof, while simultaneously overcoming some of the disadvantages normally associated therewith.

Still another object of the present invention is to provide a new firearm sighting aid device for making it easier and quicker to adjust the sights of a firearm.

Yet another object of the present invention is to provide a new firearm sighting aid device which includes a housing having an open front end, an open back end, and a compartment disposed therein with the housing being adapted to be received in a chamber of a firearm; and also includes an endcap member being removably attached to the back end of the housing to essentially close the back end of the housing and to close access to the compartment; and further includes a light-emitting member securely disposed in the compartment near the front end of the housing and being adapted to emit a beam of light through the open front end of the housing and through a bore and out of a barrel of the firearm; and also includes energizing assembly for energizing the light-emitting member.

Still yet another object of the present invention is to provide a new firearm sighting aid device that reduces the number of shots taken by the user to perfect the sights of the firearm.

Even still another object of the present invention is to provide a new firearm sighting aid device that quickly and conveniently identifies the target upon which the sights are to be adjusted accordingly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
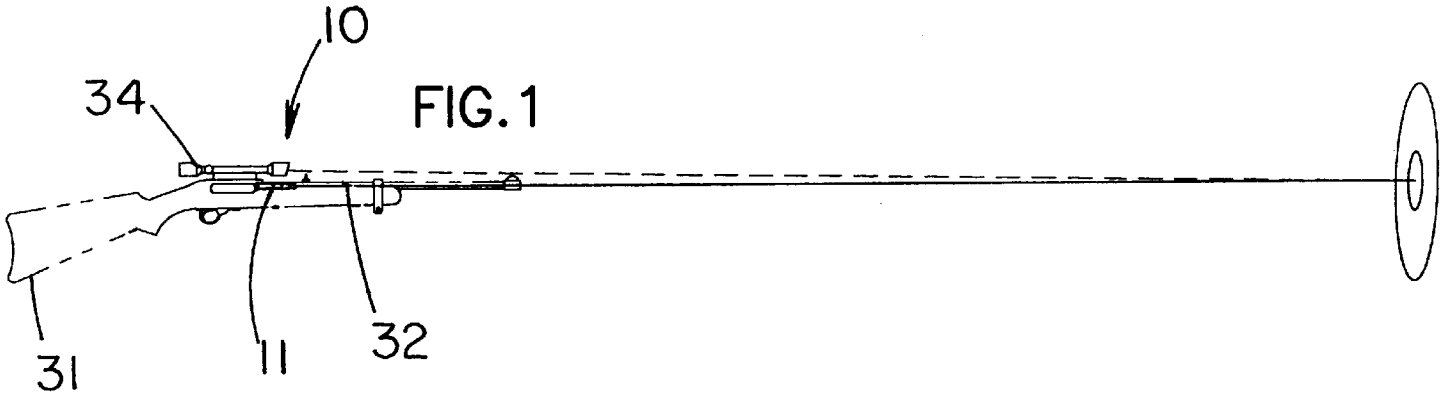
FIG. 1 is a side elevational view of a new firearm sighting aid device according to the present invention shown in use.
Figure 2:
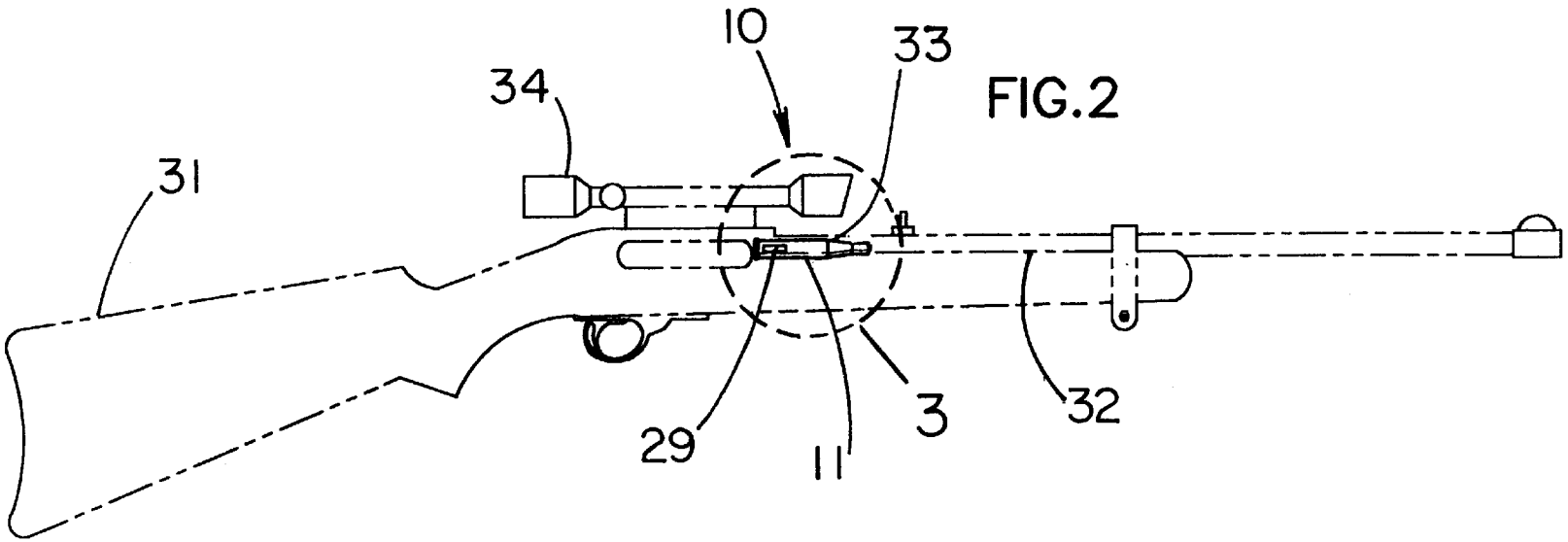
FIG. 2 is a side elevational view of the present invention showing in particular the chamber of a firearm.
Figure 3:
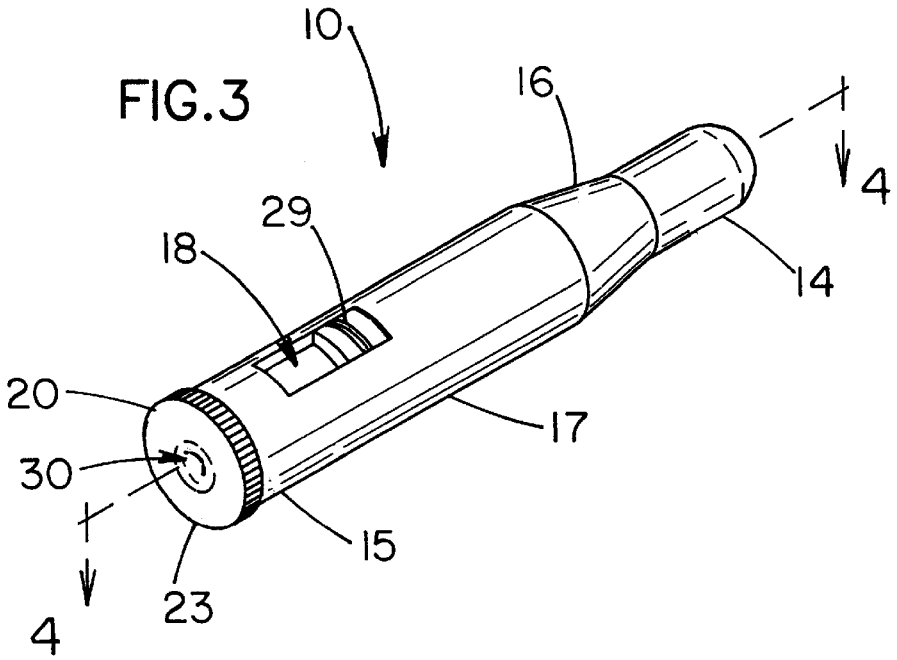
FIG. 3 is a perspective view of the present invention.
Figure 4:
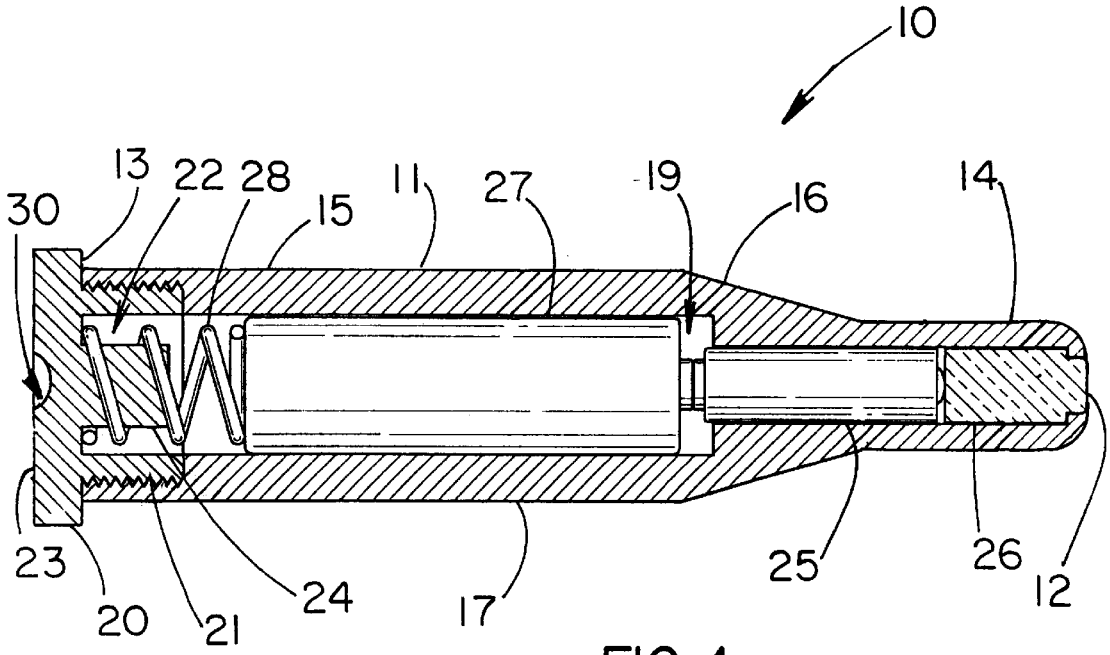
FIG. 4 is a cross-sectional view of the present invention.

With reference now to the drawings, and in particular to FIGS. 1 through 4 thereof, a new firearm sighting aid device embodying the principles and concepts of the present invention and generally designated by the reference numeral 10 will be described.

As best illustrated in FIGS. 1 through 4, the firearm sighting aid device 10 generally comprises a housing 11 having an open front end 12, an open back end 13, and a compartment 19 disposed therein. The housing 11 is adapted to be received in a chamber 33 of a firearm 31 with the housing 11 having a front end portion 14 and a rear end portion 15 which has a circumference larger than that of the front end portion 14. The housing 11 also has a tapered intermediate portion 16 with the housing 11 being shaped like that of a firearm cartridge and having a slot 18 in a side wall 17 thereof.

An endcap member 20 is removably and threadingly attached to the back end 13 of the housing 11 to essentially close the back end 13 of the housing 11 and to close access to the compartment 19. The endcap member 20 has a threaded portion 21 which is threaded into the back end 13 of the housing 11 and which has a bore 22 therein, and also has an end wall 23 securely and conventionally attached to the threaded portion 21 and having a centrally-disposed recess 30 in an outer side thereof for preventing contact with a firing pin of the firearm 31, and further has a spring support member 24 securely and conventionally attached to an inner side of the end wall 23 and being centrally-disposed in the bore 22 of the threaded portion 21.

A light-emitting member 25 is securely disposed in the compartment near the front end 12 of the housing 11 and is adapted to emit a beam of light through the open front end 12 of the housing 11 and through a bore and out of a barrel 32 of the firearm 31. The light-emitting member 25 includes a laser and a lens 26 securely disposed inside the housing 11 near the front end 12 thereof for emitting a concentrated beam of light through and out of an end of the barrel 32 of the firearm 31 and onto a target.

Means for energizing the light-emitting member 25 includes a battery 27 removably disposed inside the compartment 19 and being in contactable relationship with the light-emitting member 25, and also includes a spring 28 being conventionally supported upon the spring support member 24 for biasing the battery 27 into contactable relationship with the light-emitting member 25, and further includes a switch 29 being movably disposed and recessed in the slot 18 of the housing 11 for energizing the light-emitting member 25.

In use, the user inserts the firearm sighting aid device 10 into the chamber 33 of the firearm 31 much like the user would do with firearm cartridges, but before doing so, the user turns on the switch 29 to energize the light-emitting member 25. Inside the chamber 33 of the firearm 31, the beam of light exits the end of the barrel 32 of the firearm 31 and directs a concentrated beam onto a target. The user while looking through the sights 34 mounted upon the firearm 31 adjusts the sights such that the crosshairs of the sights 34 should intersect the beam of light on the target. If not, the user can adjusts the sights 34 accordingly. Once finished, the user removes the firearm sighting aid device 10 from the chamber 33 of the firearm 31 and turns off the light-emitting member 25 and is now ready to use the firearm 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm sighting aid device comprising:

a housing having an open front end, an open back end, and a compartment disposed therein, said housing being adapted to be received in a chamber of a firearm;

an endcap member being removably attached to said back end of said housing to close said back end of said housing and to close access to said compartment;

a light-emitting member being securely disposed in said compartment near said front end of said housing and being adapted to emit a beam of light through said open front end of said housing and through a bore and out of a barrel of the firearm; and means for energizing said light-emitting member;

wherein said endcap member has a threaded portion being threaded into said open back end of said housing, said threaded portion having a bore therein, said endcap member having an end wall attached to said threaded portion and having a centrally-disposed recess in an outer side thereof for preventing contact with a firing pin of the firearm;

wherein said housing is shaped like that of a firearm cartridge and has a slot in a side wall thereof, said slot extending in a longitudinal direction of said housing, a switch for energizing said light-emitting member, said slot being movably disposed and recessed in said slot of said housing such that said switch is accessible when said housing is positioned in a chamber of a rifle.

2. A firearm sighting aid device comprising:

a housing having an open front end, an open back end, and a compartment disposed therein, said housing being adapted to be received in a chamber of a firearm;

an endcap member being removably attached to said back end of said housing to close said back end of said housing and to close access to said compartment;

a light-emitting member being securely disposed in said compartment near said front end of said housing and being adapted to emit a beam of light through said open front end of said housing and through a bore and out of a barrel of the firearm; and means for energizing said light-emitting member;

wherein said endcap member has a threaded portion being threaded into said open back end of said housing, said threaded portion having a bore therein, said endcap member having an end wall attached to said threaded portion and having a centrally-disposed recess in an outer side thereof for preventing contact with a firing pin of the firearm;

wherein said endcap member has a spring support member attached to an inner side of said end wall and being centrally-disposed in said bore of said threaded portion.

3. A firearm sighting aid device comprising:

a housing having an open front end, an open back end, and a compartment disposed therein, said housing being adapted to be received in a chamber of a firearm, said housing having a front end portion and a rear end portion which has a circumference larger than that of said front end portion, said housing also having a tapered intermediate portion, said housing being shaped like that of a firearm cartridge and having a slot in a side wall thereof, said slot extending in a longitudinal direction of said housing, a switch for energizing said light-emitting member, said slot being movably disposed and recessed in said slot of said housing such that said switch is accessible when said housing is positioned in a chamber of a rifle;

an endcap member being removably attached to said back end of said housing to essentially close said back end of said housing and to close access to said compartment, said endcap member having a threaded portion which is threaded into said back end of said housing and which has a bore therein, and also having an end wall securely attached to said threaded portion and having a centrally-disposed recess in an outer side thereof for preventing contact with a firing pin of the firearm, and further having a spring support member securely attached to an inner side of said end wall and being centrally-disposed in said bore of said threaded portion;

a light-emitting member securely disposed in said compartment near said front end of said housing and being adapted to emit a beam of light through said open front end of said housing and through a bore and out of a barrel of the firearm, said light-emitting member including a laser and a lens securely disposed inside said housing near said front end thereof for emitting a concentrated beam of light through and out of an end of the barrel of the firearm and onto a target; and means for energizing said light-emitting member including a battery removably disposed inside said compartment and being in contactable relationship with said light-emitting member, and also including a spring being supported upon said spring support member for biasing said battery into contactable relationship with said light-emitting member.

* * * * *